United States Patent [19]

Vigneri

[11] 4,456,069

[45] Jun. 26, 1984

[54] PROCESS AND APPARATUS FOR TREATING HYDROCARBON-BEARING WELL FORMATIONS

[76] Inventor: Ronald J. Vigneri, 9 Leone Ter., Kinnelon, N.J. 07405

[21] Appl. No.: 398,289

[22] Filed: Jul. 14, 1982

[51] Int. Cl.[3] ..... E21B 43/24; E21B 43/26

[52] U.S. Cl. ..... 166/303; 166/57; 166/64; 166/75 R; 166/308

[58] Field of Search ..... 166/57, 75 R, 271, 272, 166/299, 300, 302, 303, 308, 64

[56] References Cited

U.S. PATENT DOCUMENTS

| | | | |
|---|---|---|---|
| 2,421,528 | 6/1947 | Steffen | 166/303 X |
| 2,915,122 | 12/1959 | Hulse | 166/308 X |
| 3,075,463 | 1/1963 | Eilers et al. | 166/308 UX |
| 3,200,882 | 8/1965 | Allen | 166/177 X |
| 3,700,035 | 10/1972 | Lange | 166/272 X |
| 3,746,088 | 7/1973 | Haskin et al. | 166/300 X |
| 3,848,674 | 11/1974 | McColl | 166/308 X |
| 3,980,137 | 9/1976 | Gray | 166/303 |
| 4,103,743 | 8/1978 | Paul | 166/299 |
| 4,254,828 | 3/1981 | Sowa et al. | 166/308 X |
| 4,380,265 | 4/1983 | Mohaupt | 166/308 X |

*Primary Examiner*—George A. Suchfield
*Attorney, Agent, or Firm*—Samuelson & Jacob

[57] ABSTRACT

Process and apparatus in which a hydrocarbon-bearing well formation, penetrated by a borehole, is treated with apparatus located outside the well by injecting gases into the well to elevate the pressure and temperature within the well formation so as to stimulate the formation through the effects of thermal stress and high pressure gas flow. The apparatus includes a gas generator of the type in which a reactant, such as hydrogen peroxide, is decomposed by a catalyst to form high temperature decomposition gases, such as steam and oxygen, and an air compressor for injecting compressed air into the well to aid in raising the pressure within the well formation so as to stimulate the formation, thereby increasing the permeability of the formation and the subsequent flow of fluids from the formation into the well after stimulation.

14 Claims, 2 Drawing Figures

PROCESS AND APPARATUS FOR TREATING HYDROCARBON-BEARING WELL FORMATIONS

Figure 1:
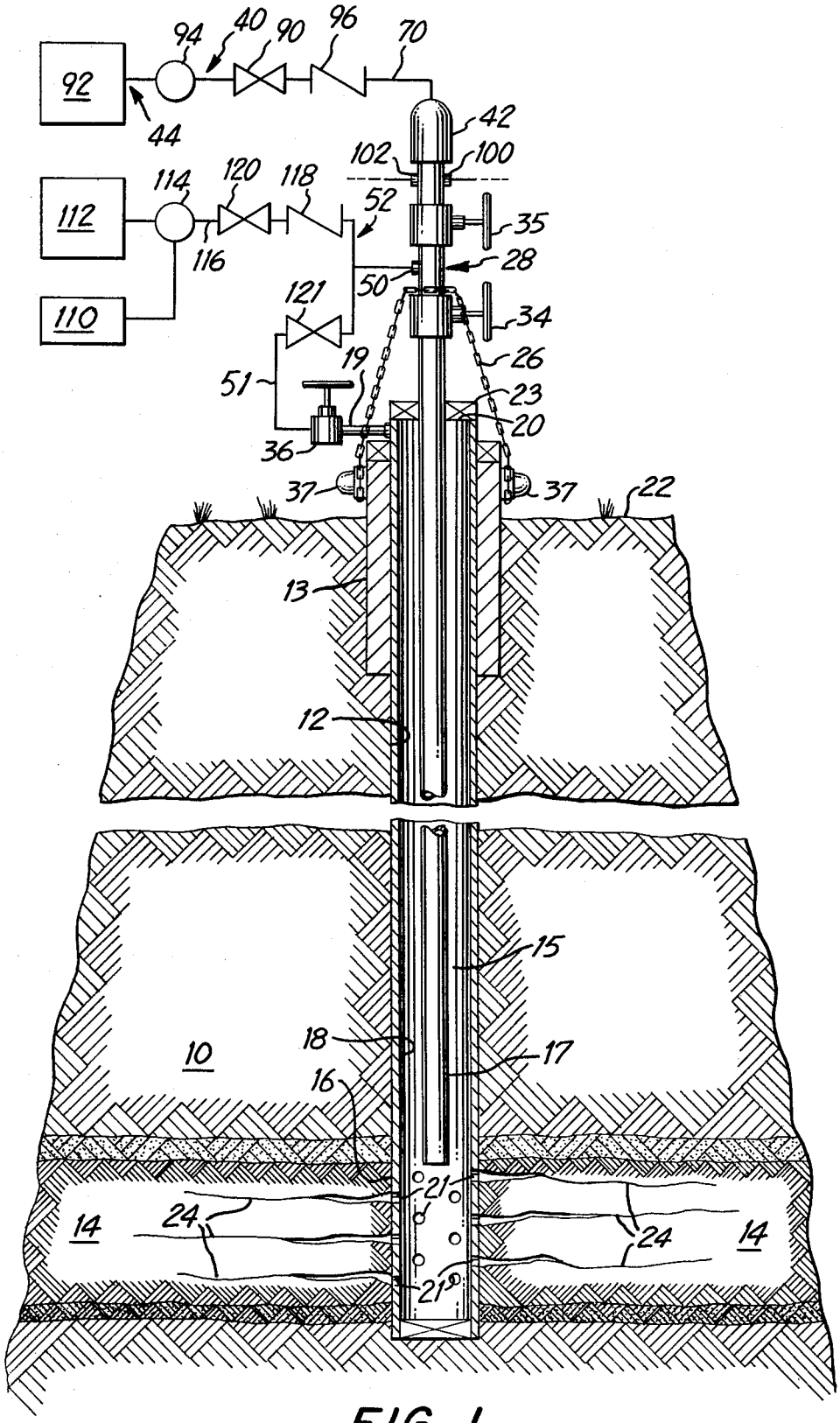

The present invention relates generally to increasing the yield of existing underground hydrocarbon-bearing well formations and pertains, more specifically, to method and apparatus for treating such formations to effect the increase in yield.

It has been known for some time that the yield of hydrocarbons, such as gas and petroleum, from wells can be increased by stimulating the well formation so as to increase the flow of hydrocarbons in the well. Various formation stimulating procedures have been proposed and many now are in use. Among these procedures are treatments with various chemicals (usually acids in aqueous solutions), hydraulic fracturing in which liquids or other fluids are injected under high pressure (usually with propping agents), explosive methods in which explosives are detonated within the formations to effect mechanical fracture, and combinations of the above procedures.

Chemical treatments usually involve the use of large volumes of chemicals which can be expensive and difficult to handle, and which pose problems of contamination and disposal. Hydraulic fracturing ordinarily requires that large volumes of liquids be made available at the well site and that equipment be made available for handling these large volumes of liquid. Again, there can be disposal problems, as well as contamination of the well. Explosive methods can be exceptionally hazardous from the standpoint of transporting and using the necessary explosives, and present difficulties in controlling the effects of such a procedure.

Other suggestions for increasing the yield of existing wells entail heating the formation to induce the flow of hydrocarbons from the formation. Methods and apparatus have been developed by which various combustion devices have been lowered into the borehole of a well to attain heating of the formation adjacent the device. The effectiveness of such devices is limited by the necessity for fitting the devices into a borehole and then obtaining only more-or-less localized effects.

It is an object of the present invention to enable an existing well formation to be stimulated effectively with aboveground equipment which easily is transported to a site, readily installed, and requires a minimum supply of materials to accomplish effective stimulation.

Another object of the invention is to provide process and apparatus for increasing the yield of an existing hydrocarbon-bearing well formation with little or no risk of contaminating the formation or the environment in the vicinity of the well formation, and without presenting a disposal problem at the site of the formation.

Another object of the invention is to provide process and apparatus of the type described and which will accomplish stimulation throughout greater areas of a formation rather than generating merely localized effects.

Still another object of the invention is to provide process and apparatus of the type described and which will demonstrate a dramatic increase in the yield of hydrocarbons from a formation within a relatively short span of time.

Yet another object of the invention is to provide process and apparatus of the type described and in which costs are sharply reduced by virtue of the requirement for less equipment and more simplified equipment and procedures which require less manpower and can be accomplished safely, economically and effectively without highly skilled specialists.

Another object of the invention is to provide readily portable apparatus which can generate superheated steam and oxygen in the field for effectively stimulating an existing well formation.

A further object of the invention is to provide process and apparatus in which known technology from the totally unrelated field of reaction motors finds a unique application in effecting a novel approach to the problem of stimulating hydrocarbon-bearing well formations.

A still further object of the invention is to provide process and apparatus of the type described and which enables subsequent further stimulation of the same formation for continuing a higher yield from a well over a longer period of time.

Yet a further object of the invention is to provide process and apparatus of the type described and which can be utilized to increase the yield from formations which heretofore have not responded to other available procedures or which even may have suffered contamination or damage as a result of attempts at using other procedures.

The above objects, as well as still further objects and advantages are attained in the present invention which may be described briefly as process and apparatus for increasing the yield of hydrocarbons from an underground hydrocarbon-bearing formation by stimulating the formation, the formation having internal fissures and being penetrated by a well including a borehole having an opening adjacent ground level, the process and apparatus including, respectively, the steps of and means for placing and connecting a decomposition gas generator in position outside the well for supplying a relatively large volume of hot decomposition gas under pressure to the opening of the borehole, essentially sealing the connection between the gas generator and the borehole opening so as to enable the establishment of elevated pressures within the formation, operating the gas generator to inject gas into the formation at a relatively high flow velocity and relatively high temperature, said high temperature being less than the thermal ignition temperature of the hydrocarbons in the formation, and continuing operation of the gas generator to increase the pressure within the formation to an elevated relatively high pressure until the formation is stimulated.

Figure 2:
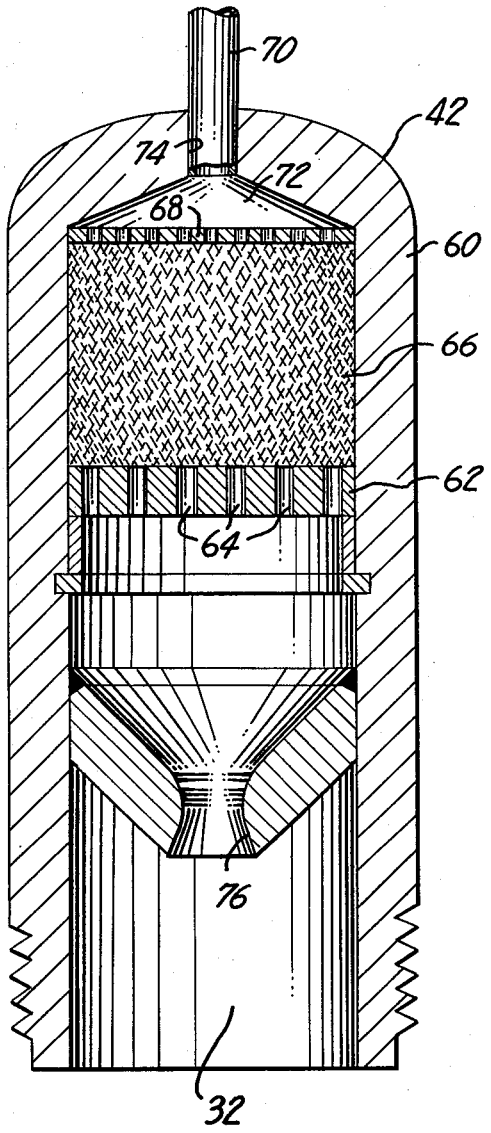

The invention will be understood more fully, while still further objects and advantages will become apparent, in the following detailed description of an embodiment of the invention illustrated in the accompanying drawing, in which:

FIG. 1 is a partially schematic diagram of an installation constructed and operated in accordance with the present invention; and FIG. 2 is an enlarged vertical cross-sectional view of a portion of the apparatus of FIG. 1.

Referring now to the drawing, and especially to FIG. 1 thereof, an underground hydrocarbon-bearing well formation is illustrated schematically at 10 and is seen to be penetrated by a borehole 12 which extends downwardly into a production formation 14 to establish a well 16 from which hydrocarbons, such as petroleum or gas, can be drawn, usually through a string of production tubing 17. A well casing 18 has an opening 20 at the upper end of the casing, only slightly above ground level 22, the lower end of the well casing 18 extending into the production formation 14 within the overall well formation 10 and including perforations 21 through which hydrocarbons will flow from the well formation into the well itself. The borehole 12, tubing 17 and well casing 18 are parts of an existing single-zone perforated well structure, having been constructed in accordance with known principles of petroleum and gas well construction.

In order to increase the yield of hydrocarbons from well 16, production formation 14 is to be stimulated utilizing the process and apparatus of the present invention. That is, fissures 24 in the production formation 14, through which the hydrocarbons flow into the well 16, either will be unclogged or will be enlarged, or new fissures will be formed by fracturing of the production formation 14 in the vicinity of the well 16. Stimulation is accomplished by sealing the well 16 and then injecting gases at relatively high temperature and elevated pressures. By introducing a high pressure, high velocity, highly turbulent gas flow of sufficient volume, the formation will be fractured and fines will be created in-situ to prop the resulting fractures.

Well 16 is prepared by installing a chain anchor 26 around a tubing master valve 34 and bull plugs 37 in a supplemental surface casing 13 adjacent the opening 20 of well casing 18, and borehole 12. An adaptor nipple 28 is affixed to the master valve 34. A treatment valve 35 is located above the adaptor sleeve 28 and a sealing valve 36 is placed on an annular output nipple 19 of well casing 18. When master valve 34 is closed, the well 16 essentially is sealed. The space between the outside wall diameter of tubing 17 and the inside diameter of casing 18 is referred to as the "well production annulus" or annulus 15, herein.

The system for elevating the pressure in the well 16 and for injecting gases at relatively high temperatures is shown schematically at 40. System 40 includes a gas generator 42 secured to the treatment valve 35 and having a reactant supply system 44 for supplying liquid reactant to react in the gas generator 42 to generate gases, in a manner which will be described in greater detail hereinafter, and a compressed gas inlet 50 having a compressed gas supply system in the form of compressed air supply system 52.

Basically, the process of the present invention entails placing and connecting a gas generator, such as gas generator 42, in position outside the borehole 12 of well 16 for supplying heated gas under pressure to the opening 20 of the borehole, essentially sealing the connection between the gas generator and the borehole opening, as accomplished by a casing or tubing head seal 23, so as to enable the establishment of elevated pressures within the borehole 12, and well 16, operating the gas generator to inject gas into the borehole at a relatively high temperature and relatively low viscosity, the high temperature being somewhat less than the thermal ignition temperature of the hydrocarbons in the production formation 14, increasing the pressure, with the high temperature gas, within the borehole and production formation 14 until the production formation is stimulated to increase permeability, which enhances the flow capabilities for the hydrocarbon fluids (gas and liquid) contained in the formation. Such an increase in permeability is attained by fracturing the formation, by creating new flow channels or increasing the size of existing flow channels in the formation or by removing elements such as parafin which otherwise would inhibit flow through the flow channels. In a typical installation where the thermal ignition temperature of the hydrocarbons in the well 16 is about 1250° F., the relatively high temperature of the gas injected into the borehole by the gas generator would be about 500° F. to 1000° F., the maximum temperature being limited by the temperature which can be tolerated by the existing well components. The elevated relatively high pressure typically would be at least 500 psia to 5000 psia and, depending upon the structure of production formation 14, can go higher, the maximum pressure being limited only by the pressure saturation characteristics of the gas being introduced to establish the high pressure.

Turning now to FIG. 2, as well as to FIG. 1, the specific gas generator 42 of illustrated system 40 is shown in vertical cross-section and is seen to include a housing 60 within which there is mounted a perforated plate 62 having a plurality of openings 64. A catalyst assembly 66 is supported in the housing above the perforated plate 62 and extends upwardly to a distribution plates 68. Reactant is fed to the housing 60 through a reactant line 70 and enters chamber 72 within housing 60 at an inlet 74. The reactant and the catalyst are chosen from among those substances which will cause the reactant to react upon passing through the catalyst assembly 66 and generate a large volume of decomposition gas at a high temperature determined by the chemical composition of the reactant. The decomposition gases will pass downwardly through the openings 64 in perforated plate 62 and then through an orifice 76 and into manifold 32. The preferred reactant is hydrogen peroxide ($H_2O_2$) which will be decomposed by a suitable catalyst, such as silver, to generate large volumes of high temperature steam and oxygen. Other reactants are available which will be decomposed by a catalyst to form high temperature decomposition gases in large volumes. Thus, other reactants which contain oxidizers and combustibles are available and may be used in monopropellant or bipropellant forms. The technology of devices constructed to operate in the above-described manner is well-developed and has been used extensively in the field of reaction motors. Such technology is discussed in "HYDROGEN PEROXIDE ROCKET MANUAL" by James C. McCormick, FMC Corporation, Buffalo, N.Y., 1970.

The large volumes of high temperature gases made available by gas generator 42 at relatively high velocity enables the gas generator to be placed outside the opening 20 of well casing 18 and connected to the well casing by means of valve 35 and adaptor nipple 28. The gases existing from manifold 32 are at a very high temperature and are flowing at high velocity. Preferably, the temperature of the decomposition gases is controlled to maintain the temperature below the thermal ignition temperature of the hydrocarbons in the production formation 14 by proper mixing of the chemical constituents of the reactant prior to use of the reactant in the system. Alternately, external cooling may be employed.

A control valve 90 in the reactant line 70 controls the flow of reactant to gas generator 42. Reactant is supplied from a reactant tank 92 by a reactant pump 94 through control valve 90 and a check valve 96 to gas generator 42 at a rate which enables the desired volume, velocity and pressure in the flow of decomposition gases. The amount of reactant is regulated so as to enable the gas generator to fill the well 16 and formation fissures 24 with decomposition gases at high temperature (just below the thermal ignition temperature of the hydrocarbons in the formation) at an elevated pressure. The high velocity enables turbulent flow of the decomposition gases within the fissures 24 at rates which produce abrasion of the surface of any fractures, flow channels and fissures so as to create proppant in-situ, and with the application of a sufficient volume of high pressure and high temperature gases at a sufficient flow rate and duration to fracture the well formation. A pressure sensor 100 and a temperature sensor 102 are placed in the gas generator 42 to monitor pressure and temperature in the well 16. Gas generator 42 may be operated periodically in order to maintain the appropriate high pressure and high temperature within the well for a sufficient length of time to attain stimulation. In addition, gas generator 42 may be operated in a pulsed mode.

A compressed air supply system 52 is used advantageously to elevate the pressure in well 16 to an initial pressure prior to operation of the gas generator 42. Thus, compressed air supply system 52 includes an engine-driven air compressor 110 which establishes a supply of air under pressure in a storage tank 112. A regulator and filter unit 114 feeds air to an air line 116 connected to air inlet 50 through a check valve 118 and a control valve 120. In this manner, gas generator 42 can be utilized most efficiently to bring the pressure in the well 16 from an initial elevated pressure up to the required stimulating pressure, thus taking advantage of the operating characteristics of the gas generator 42, while the compressed air supply system 52 can best be utilized to conserve the cost of creating more decomposition gases from the operation of gas generator 42 than is necessary, as determined by the physical characteristics of the formation to be stimulated. The elevation of the pressure within the well 16 to an initial pressure by compressed air supply system 52, rather than by gas generator 42, also serves as an economical test procedure to determine if well 16 is adequately sealed to hold an elevated pressure for effective fracturing of the formation. It would be wasteful to operate gas generator 42 in an attempt to pressurize a well which is not amenable to pressurization.

In some instances treatment fluids, such as acids, bacteriocides and the like, have been placed in the well prior to stimulation with the process and apparatus of the present invention. A further control valve 121 is utilized in conjunction with sealing valve 36 such that air from system 52 can be injected simultaneously into the annulus 15, as well as into production tubing 17, to place such treatment fluids under pressure in the formation. The use of appropriate treatment fluids can assist stimulation of the well.

The following examples illustrate the application of the present process to existing wells, utilizing apparatus constructed in accordance with the invention.

EXAMPLE 1

The process was practiced on a new petroleum well having a casing internal diameter of 4½ inches and a production tubing internal diameter of 2⅜ inches. The production formation of the well was located at a depth of 1749 feet in a Berea sandstone formation including sixteen perforations, each have a diameter of ½ inch, and located along an eight foot length, to a depth of 1757 feet. The sandstone formation had been cemented-off from the perforations in the well casing so that no fluids flowed into the wellbore. In an attempt to break down the cement, 200 gallons of 28% hydrochloric acid had been delivered into the well to cover the sixteen perforations, from a depth of 1749 feet to 1757 feet. The acid treatment was without success. Following the present process, air was injected into the production tubing and the well production annulus until a pressure of 350 psig was attained. The air was delivered at a rate of 255 scfm (standard cubic feet per minute) and reached a volume of 2296 scf (standard cubic feet). Then, hot decomposition gases (superheated steam and oxygen) were injected at a temperature of 550° F. and a flow rate of 1300 scfm until the pressure in the well reached 2115 psig. At that point, an abrupt drop was observed in the pressure in the well, indicating that the production formation had broken down and that there was an increase in permeability of the formation. Injection was continued until a total volume of 40,000 scf of decomposition gases has been injected into the well. A total heat content of $1.9\times10^6$ BTU had been placed in the well and the bottom hole temperature reached approximately 490° F. During injection of the hot decomposition gases, the velocity of the gases in the production tubing was about 29 ft/sec. and the Reynolds number was about $1.5\times10^6$, indicating highly turbulent flow. The peak bottom hole pressure was about 2117 psig. Upon completion of the injection of hot decomposition gases, the well head pressure was 750 psig. The duration of the injection of hot decomposition gases was about thirty minutes.

As a result of the above process, production from the well was stimulated from essentially no production to 0.85 barrels of oil per day (BOD). The abrasive quality of the high volume, high velocity, highly turbulent flow was verified by the recovery of substantial Berea sandstone fines. The stimulation procedure established that fines could be created in-situ, in connection with the stimulation of production.

EXAMPLE 2

The process was practiced on a gas well in an Upper Devonian Shale formation. The well casing had an inside diameter of 4½ inches, while the production tubing had an inside diameter of 2 inches, the well having a depth of 2650 feet, with fifteen perforations of about ⅜ inches diameter extending over a fifty foot section at the bottom of the well. Here again, 400 gallons of acid (3% hydrofluoric, 12% hydrochloric) were placed in the well to cover the perforations. Nitrogen was injected into the tubing and the annulus at a flow rate of 2000 scfm for 30 minutes which raised the pressure in the well to 1100 psig. A total volume of 60,000 scf of nitrogen was injected during that step of the process. Then, hot decomposition gases, in the form of superheated steam and oxygen, were injected at a temperature of 600° F. and a flow rate of 1548 scfm until a pressure of 1550 psig was reached. An abrupt decrease in pressure was observed, indicating breakdown of the formation, and injection was continued until a volume of about 40,000 scf had been injected in about 25 minutes, with the final pressure being 1000 psig. The flow velocity of the injected hot decomposition gases was 19.6 ft/sec. in the tubing, with a Reynolds number of about $2.1\times10^6$, indicating very high turbulence. Subsequently, nitrogen was injected at a flow rate of 3500 scfm, at 1000 psig, for thirty minutes, after which the pressure rose only to 1350 psig indicating an increase in permeability of the formation.

As a result of the above process, well production increased from about 5000 cfd to an average of 35,000 cfd, with peaks at 51,000 cfd.

EXAMPLE 3

The process was practiced on a gas and petroleum well having a depth of 2256 feet and including a Big Injun sand production formation at 1800 to 1820 feet with ⅜ inch perforations extending along six feet of casing, and a Berea sand formation at a depth of 2200 to 2208 feet with ⅜ inch perforations extending along an eight foot length of the casing. The casing had an inside diameter of five inches. Air was injected into the sealed well until the pressure was raised to 280 psig. Then, hot decomposition gases were injected, by operation of the gas generator, utilizing 200 gallons of hydrogen peroxide, until the pressure in the well reached 690 psig and the temperature rose to 675° F., after about fifteen minutes. An abrupt decrease in pressure then was observed, the pressure dropping to about 460 psig after a total of forty-five minutes. Subsequently, air was injected again and the pressure within the well was brought up to 490 psig within one hour. Thereafter, the well was shut-in for about 12 hours.

As a result of the above process, production of petroleum from the well increased from an average of one barrel per day to 23 barrels per day and the production of gas from the well increased from an average of 1000 cfd to 5000 cfd for the next 76 days during which data was collected.

EXAMPLE 4

The process was practiced on a petroleum well in a Berea sand formation. The well casing had an inside diameter of 4½ inches, while the production tubing had an inside diameter of 2⅜ inches, the well having a depth of 2520 feet, with ⅜ inch diameter perforations placed three per foot along an eight foot section at the bottom of the well. Air was injected into the sealed well until the pressure was raised to 350 psig, after about twenty-two minutes. Then, hot decomposition gases were injected, by operation of the gas generator, utilizing 200 gallons of hydrogen peroxide, until the pressure in the well reached a peak of 750 psig and the temperature rose to 750° F., at the end of thirty minutes. The pressure decreased to 650 psig at the end of thirty-five minutes, after which injection was discontinued.

As a result of the above process, production from the well increased from a rate of about one barrel per week to about twelve barrels per week average over thirty six days and then fell to about seven barrels per week through the next 125 days.

It is pointed out that the decomposition gases supplied by gas generator 42 are steam and oxygen. The steam is super-heated steam at a very high temperature. The presence of oxygen in the injected decomposition gas provides the added benefit of sterilizing the well by oxidation. The presence of steam and oxygen poses no problem of contamination or disposal. The amount of water remaining after the steam is condensed is very little in comparison to the amounts of water required in other formation fracturing processes. The benign nature of the decomposition gases and the ease with which the gases are generated quickly in the quantities required and then disposed of enables the process to be used repeatedly, if necessary, without excessive logistical problems, without contamination of the well or the well environment, and without the requirement for any period of non-productive clean-up pumping of the well to expell fracturing materials or by-products.

The nature of the supplies and the equipment necessary to install and operate system 40 in the field simplifies transportation and site requirements and renders the method and apparatus exceptionally economical. The ease with which the system is installed and utilized enables the system to be operated by workers requiring only limited training.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. The process for increasing the yield of hydrocarbons from an underground hydrocarbon-bearing formation by stimulating the formation, the formation having internal fissures and being penetrated by a well including a borehole having an opening adjacent ground level, the process comprising the steps of:

placing and connecting a decomposition gas generator in position outside the well for supplying a relatively large volume of hot decomposition gas under pressure to the opening of the borehole;

essentially sealing the connection between the decomposition gas generator and the borehole opening so as to enable the establishment of elevated pressures within the formation;

operating the gas generator to generate decomposition gas and inject the decomposition gas into the formation at a relatively high flow velocity and relatively high temperature, said high temperature being less than the thermal ignition temperature of the hydrocarbons in the formation; and continuing operation of the decomposition gas generator to increase the pressure within the formation to an elevated relatively high pressure until the formation is stimulated.

2. The invention of claim 1 wherein the step of increasing the pressure within the well includes:

raising the pressure within the well to an initial elevated pressure prior to operation of the gas generator; and subsequently operating the gas generator to increase the pressure within the well to a pressure sufficient to stimulate the formation.

3. The invention of claim 1 wherein the step of increasing the pressure within the well includes:

injecting compressed gas, such as air, into the well to raise the pressure within the well to an initial elevated pressure prior to operation of the gas generator; and subsequently operating the gas generator to increase the pressure within the well to a pressure above the initial elevated pressure sufficient to stimulate the formation.

4. The invention of claim 1 wherein the heated gas includes superheated steam.

5. The invention of claim 4 wherein the heated gas includes oxygen.

6. The invention of claim 1, 2, 3, 4 or 5 wherein the gas generator is operated to inject gas into the well at a relatively high injection volume rate and high velocity with highly turbulent flow in the fissures of the formation.

7. Apparatus for increasing the yield of hydrocarbons from an underground hydrocarbon-bearing well formation by fracturing the formation, the formation having internal fissures and being penetrated by a well including a borehole having an opening adjacent ground level, said apparatus comprising:

decomposition gas generator means for operating to generate decomposition gas under pressure and in a relatively large volume at a relatively high velocity and a relatively high temperature, said high temperature being less than the thermal ignition temperature of the hydrocarbons in the formation;

means for placing and connecting the decomposition gas generator means in position outside the well for injecting said high temperature decomposition gas under pressure and in a relatively large volume at high velocity through the opening of the borehole and into the formation; and means for essentially sealing the connection between the decomposition gas generator means and the borehole opening so as to enable the injection of the high volume, high velocity decomposition gas into the formation to attain elevated pressures within the well at least until the formation is stimulated.

8. The invention of claim 7 including supplemental means for increasing the pressure within the well independent of the gas generator and for maintaining said increased pressure.

9. The invention of claim 8 wherein the supplemental means includes means for injecting compressed gas, such as air, into the well to raise the pressure within the well independent of the operation of the gas generator.

10. The invention of claim 8 or 9 wherein the supplemental means includes a motor-driven gas compressor connected to the opening of the borehole.

11. The invention of claim 7 wherein the gas generator is of the type in which a reactant is decomposed by a catalyst to form high temperature decomposition gases.

12. The invention of claim 11 wherein the reactant is hydrogen peroxide and the high temperature decomposition gases include steam.

13. The invention of claim 11 wherein the reactant is hydrogen peroxide and the high temperature decomposition gases include oxygen.

14. The invention of claim 11 including means for regulating the flow of reactant to the gas generator so as to attain the relatively high velocity and high volume rate of flow.

* * * * *